US006428128B1

(12) United States Patent
Henriott et al.

(10) Patent No.: US 6,428,128 B1
(45) Date of Patent: Aug. 6, 2002

(54) DRAWER FOR STANDARDIZED FURNITURE UNIT

(75) Inventors: Jay M. Henriott, Jasper; Grover L. Miller, Chrisney; Chad M. Schnell, Jasper; Gregory K. Davis, Huntingburg, all of IN (US)

(73) Assignee: Kimball International, Inc., Jasper, IN (US)

( * ) Notice: Subject to any disclaimer, the term of this patent is extended or adjusted under 35 U.S.C. 154(b) by 0 days.

(21) Appl. No.: 09/707,399

(22) Filed: Nov. 7, 2000

Related U.S. Application Data

(62) Division of application No. 09/146,479, filed on Sep. 3, 1998.
(60) Provisional application No. 60/058,311, filed on Sep. 9, 1997.

(51) Int. Cl.[7] ..... A47B 88/00
(52) U.S. Cl. ..... 312/334.12; 312/334.7
(58) Field of Search ..... 312/334.7, 334.8, 312/334.9, 334.11, 334.12, 334.27

(56) References Cited

U.S. PATENT DOCUMENTS

| | | | |
|---|---|---|---|
| 1,039,548 | A | 9/1912 | Kral |
| 1,318,011 | A | 10/1919 | Schiavone |
| 1,849,809 | A | 3/1932 | Showers |

(List continued on next page.)

FOREIGN PATENT DOCUMENTS

| | | |
|---|---|---|
| AT | 226910 | 4/1963 |
| BE | 501535 | 5/1952 |
| CH | 247411 | 12/1947 |
| DE | 1112266 | 8/1961 |
| EP | 0011675 | 6/1980 |
| FR | 1450167 | 7/1966 |
| GB | 706596 | 3/1954 |
| GB | 2074014 | 3/1981 |

OTHER PUBLICATIONS

"Tandem Installation Specifications", Blum Catalog.
"Quadro 50 Over Extension Progressive Motion", Hettich Catalog.

*Primary Examiner*—Peter M. Cuomo
*Assistant Examiner*—Hanh V. Tran
(74) *Attorney, Agent, or Firm*—Baker & Daniels

(57) ABSTRACT

A standardized furniture unit in which a drawer moves in a longitudinal direction and has a plurality of closed positions, having a first slide element attached to a stationary panel, the drawer having a shell, a second slide element attached thereto The first and second slide elements are coupled together and move relative to each other, one of which is provided with at least one set of a plurality of mounting holes aligned along the longitudinal direction. Each of the mounting holes in each set corresponding to a different drawer closed position, and one of the mounting holes in each set is aligned with a standardized slide element mounting point in either the stationary panel or the drawer shell. The unit may comprise a lock mechanism attached to the stationary panel, with the drawer provided with a plurality of lock bays aligned along the longitudinal direction, each corresponding to a different drawer closed position and selectively engaged with the lock mechanism, the drawer lockable in each of its closed positions. The drawer shell may have a side panel in which a groove is provided which extends in the longitudinal direction. A hat-shaped insert is mounted in the groove and is attached to the shell outside of the groove. A slide element is disposed in the hat-shaped section to minimize the space required between the drawer side panel and the adjacent panel. Opposing side panels of the drawer may be provided with a file support rail having a file support extension made of a first material and a tip made of a second, softer material.

5 Claims, 12 Drawing Sheets

U.S. PATENT DOCUMENTS

| | | | | | |
|---|---|---|---|---|---|
| 1,943,099 | A | | 1/1934 | Tobey | |
| 2,215,881 | A | | 9/1940 | Levensten | |
| 2,309,863 | A | | 2/1943 | North | |
| 2,566,015 | A | | 8/1951 | Borchers | |
| 2,698,214 | A | | 12/1954 | Skamser | |
| 2,787,490 | A | | 4/1957 | Gravino | |
| 3,195,171 | A | | 7/1965 | Klein | |
| 3,272,581 | A | | 9/1966 | Stucki | |
| 3,321,253 | A | * | 5/1967 | Everburg | 312/334.7 X |
| 3,456,996 | A | | 7/1969 | Heiniger-Schar | |
| 4,141,525 | A | | 2/1979 | Miller | |
| 4,162,114 | A | * | 7/1979 | Litchfield et al. | 312/334.1 |
| 4,190,306 | A | | 2/1980 | Litchfield et al. | |
| 4,227,750 | A | * | 10/1980 | Rock et al. | 312/334.13 X |
| 4,232,921 | A | * | 11/1980 | Peele | 312/334.18 X |
| 4,244,546 | A | | 1/1981 | Mertes et al. | |
| 4,392,696 | A | | 7/1983 | Litchfield et al. | |
| 4,418,967 | A | | 12/1983 | Winkelman, Jr. et al. | |
| 4,427,245 | A | | 1/1984 | Litchfield et al. | |
| 4,440,461 | A | * | 4/1984 | Powell et al. | 312/334.8 |
| 4,458,964 | A | * | 7/1984 | Hardy | 312/334.12 |
| 4,576,423 | A | | 3/1986 | Hendriks | |
| 4,600,248 | A | | 7/1986 | Pflieger | |
| 4,653,821 | A | | 3/1987 | Faust | |
| 4,657,319 | A | | 4/1987 | Zacky et al. | |
| 4,705,326 | A | | 11/1987 | Craig | |
| 4,925,258 | A | * | 5/1990 | Ludwig et al. | 312/334.11 X |
| 5,090,787 | A | | 2/1992 | Harley | |
| 5,211,461 | A | | 5/1993 | Teufel et al. | |
| 5,466,060 | A | | 11/1995 | Hoffman | |
| 5,470,143 | A | | 11/1995 | Gill | |
| 5,577,821 | A | | 11/1996 | Chu | |
| 5,588,729 | A | | 12/1996 | Berger | |
| 5,618,092 | A | | 4/1997 | Doud et al. | |

* cited by examiner

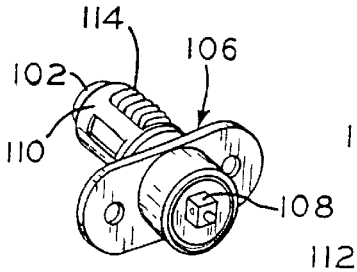
FIG_30
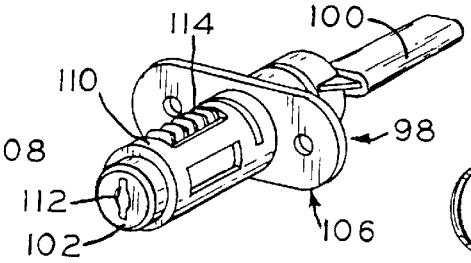
FIG_31
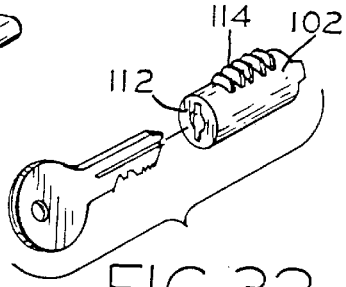
FIG_32
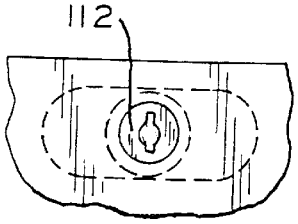
FIG_33
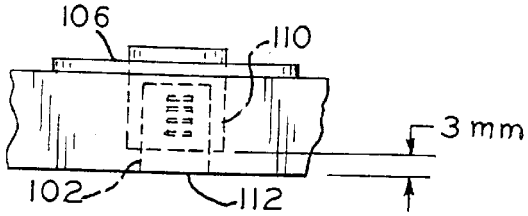
FIG_34
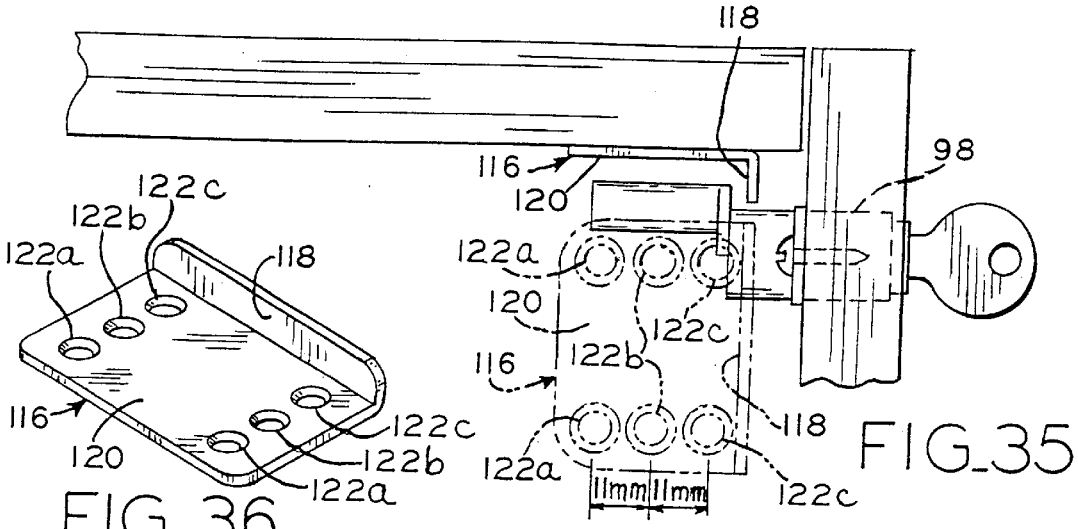
FIG_35
FIG_36
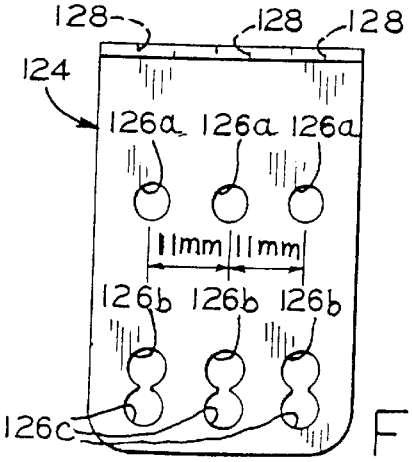
FIG_37
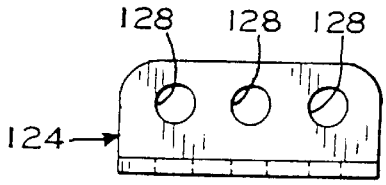
FIG_38

DRAWER FOR STANDARDIZED FURNITURE UNIT

This is a division of application Ser. No. 09/146,479, filed Sep. 3, 1998.

CROSS REFERENCE TO RELATED APPLICATIONS

This application claims the benefit under Title 35, U.S.C. §119(e) of U.S. Provisional Patent Application Ser. No. 60/058,311, entitled STANDARDIZED FURNITURE SYSTEM AND METHOD OF MANUFACTURE, filed on Sep. 9, 1997.

BACKGROUND OF THE INVENTION

1. Field of the Invention

The present invention relates to furniture systems, and, more particularly, to drawers for standardized furniture units comprising such systems.

2. Description of the Related Art

Furniture manufacturers often manufacture several different product lines of furniture systems, such as office furniture systems, with each product line having a different style or aesthetic appearance. Although many of the individual units of these different product lines are similar, typically each product line is independently designed and developed and component parts of each product line, such as drawers and their related hardware, although similar, are not often interchangeable. This lack of interchangeability may also be present for similar components of different furniture units within a single product line resulting in a large number of distinct components which must be inventoried and utilized in the manufacture of furniture systems.

SUMMARY OF THE INVENTION

The present invention provides a drawer and its related hardware for a standardized furniture unit, which can be adapted to accommodate various styles and designs of the furniture unit.

One of the basic building blocks of the standardized furniture system of the present invention is the use of common underlying structures for individual furniture units which may be combined in a modular office furniture system. For example, a common structure for a pedestal unit may be used as the basis for a large variety of different pedestal styles. These pedestal units are designed to permit their combination with other furniture units and components such as standard sized worksurface panels and modesty panels whereby desks and workstations may be easily manufactured by assembling these various units. The common underlying structures may be utilized to manufacture product lines having different styles by the use of distinguishable drawer fronts, doors, moldings, rails, skirting and other features.

To facilitate the compatibility of the different furniture units, the interchangeability of hardware and panels, and promote the efficient machining of the panels and other parts such as drawers, a 32 millimeter (mm) grid is utilized in the design and manufacture of the common underlying structures and other furniture components. A computer assisted design/computer assisted manufacturing system (CAD/CAM system) is utilized with numeric control machinery in the design and manufacture of many of the component parts and panels of the common underlying furniture unit structures and for other panels used in the future system. The use of such a CAD/CAM system can greatly facilitate the efficient manufacture of furniture panels on an as needed basis.

The drawers of the present invention utilize drawer shells having standard sizes and which utilize common drawer mounting and locking hardware. The drawers are mountable in a standard pedestal structure in three different positions, i.e., an overlay position, a ½ inset position, and a fully inset position. The common drawer mounting and locking hardware utilized by the standard drawer shells includes a drawer slide which is mountable in each of the three different drawer positions, a three bay lock block positioned at a standard location on each drawer shell and which functions for each of the three drawer positions, and a common locking bar which is adaptable for use with pedestal units having different drawer configurations. Also provided are drawer fronts which are attachable to the standard drawer shells to distinguish drawers from different product lines and provide a platform for ornamentation.

An advantage of the present invention is that it reduces the number of drawer shells and related hardware which must be inventoried and tracked during the manufacture of standardized furniture units.

One aspect of the present invention provides a standardized furniture unit in which a drawer moves in a longitudinal direction and has a plurality of closed positions. The inventive furniture unit comprises a stationary panel with a first slide element attached thereto. The drawer has a shell with a second slide element attached thereto. The first and second slide elements are coupled together and move relative to each other, and one of the first and second slide elements is provided with at least one set of a plurality of mounting holes aligned along the longitudinal direction, each of the mounting holes in each said set corresponding to a different drawer closed position. One of the mounting holes in each set is aligned with a standardized slide element mounting point in the stationary panel or the drawer shell, and the alignment of different ones of the plurality of slide element mounting holes with the standardized slide element mounting point results in a different drawer closed position. Additionally, certain embodiments of the inventive furniture unit have a lock mechanism attached to the stationary panel, with the drawer provided with a plurality of lock bays aligned along the longitudinal direction, each lock bay corresponding to a different drawer closed position. The lock mechanism is selectively engaged with one of the lock bays thus making the drawer lockable in each of its closed positions.

Another aspect of the present invention provides a furniture unit in which a drawer moves in a longitudinal direction, the drawer comprising a shell having a side panel in which a groove is provided, the groove extending in the longitudinal direction. An insert having a hat-shaped cross section is mounted in the groove and attached to the shell outside of the groove. A slide element is disposed in the hat-shaped section such that the space between the drawer side panel and an adjacent member is minimized.

Another aspect of the present invention provides a lockable enclosure comprising a panel having an exterior surface, an aperture provided through the panel and having a bore portion provided in the exterior panel surface, the bore portion defining an edge surface. A lock assembly having a shell surrounding a core which extends from the shell is disposed in the bore portion, with the edge surface of the bore portion adjacent the lock assembly core. This aspect of the present invention provides improved appearance over prior lockable enclosures by minimizing the externally visible portion of the lock.

Yet another aspect of the present invention provides a furniture unit in which a drawer moves in a longitudinal direction, the drawer having opposing side panels, at least two of which are each provided with a file support rail. The file support rail has a file support extension comprising a first material and having a tip comprising a second material, the first material harder than the second material.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein:

FIG. 30 is a rear perspective view of a lock assembly;

FIG. 31 is a front perspective view of a lock assembly;

FIG. 32 is a perspective view of a key and a lock core;

FIG. 33 is a front view of an installed lock assembly;

FIG. 34 is a top view of the installed lock assembly of FIG. 33;

FIG. 35 is a side view of a lock assembly and a three position lock bracket alternatively mounted to top and side panels;

FIG. 36 is a perspective view of a three position lock bracket;

FIG. 37 is a top view of a suspension bracket;

FIG. 38 is a side view of a suspension bracket;

Figure 1:
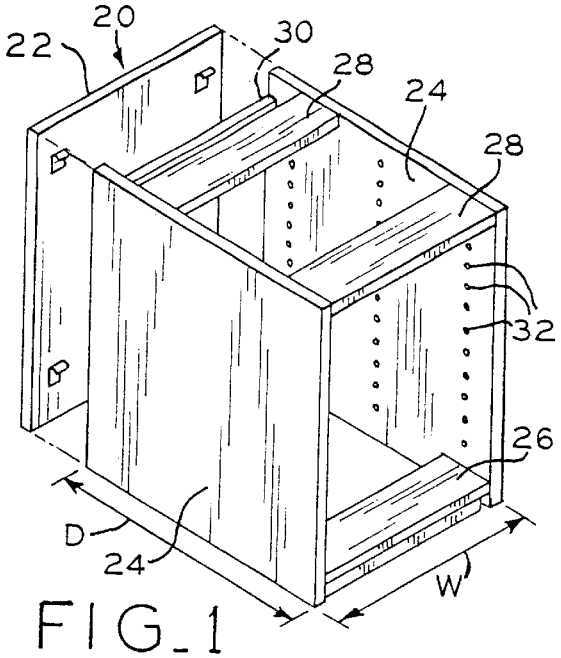
FIG. 1 is a perspective view of the underlying structure of a pedestal unit.

Corresponding reference characters indicate corresponding parts throughout the several views. Although the drawings represent embodiments of the present invention, the drawings are not necessarily to scale and certain features may be exaggerated in order to better illustrate and explain the present invention. The embodiments disclosed in the following detailed description are not intended to be exhaustive and are not to be construed as limiting the scope of the invention to the precise forms disclosed.

DESCRIPTION OF THE PRESENT INVENTION

The present invention provides a system for manufacturing office furniture systems in a standard and efficient manner. The present invention also provides several individual parts and methods which are useful in the manufacture of office furniture systems as described below.

The utilization of a grid system provides significant advantages in the design and manufacture of office furniture systems. The grid is a set of points defining a rectilinear grid pattern of points defined by the intersection of columns and rows (oriented at a 90° angle relative to each other) wherein the columns and rows are offset by 32 mm. Bore holes for connectors, dowels, shelf supports, drawer slides, etc. located on the panels used in the furniture system are placed on the grid, i.e., centered on one of the points where the columns and rows intersect. The first vertical column of the grid is spaced 37 mm from the front edge of vertically oriented panels and the grid is expandable in 32 mm increments from that column. The 37 mm spacing of the first grid column from the front edge of vertically oriented columns was chosen to facilitate the use of a significant quantity of hardware available in the market which employs this spacing. Employing a common grid for all product lines and all types of furniture units enhances the potential for utilizing common parts in each product line and between furniture units within a product line.

A 32 mm grid is advantageous because many suppliers manufacture high quality, price competitive "off the shelf" hardware fixtures using increments of 32 mm and the use of a grid based upon 32 mm facilitates the use of these hardware fixtures. The selection of 32 mm is also advantageous because the equipment used to machine the furniture panels is available with drill/spindles which are spaced to have center to center distances which are increments of 32 mm.

Referring now to FIG. 1, some basic components of a standardized furniture unit according to the present invention are shown. FIG. 1 shows the underlying structure 20 of a pedestal unit which is suitable for use under the worksurface of a desk or workstation or as a freestanding unit. Illustrated pedestal structure 20 utilizes standardized components such as a standard back panel 22 which pops on and off, standard side panels 24, L-shaped bracing members 26, top bracing members 28 and back bracing members 30. Side panels 24 include blind bore holes 32 which are positioned on a 32 mm grid with the first vertical line of holes spaced a distance of 37 mm from the front edge of side panels 24. The use of interchangeable standardized components allows pedestal structure 20 to be manufactured in a plurality of different sizes and for a plurality of different product lines while utilizing a minimal number of different parts. For example, a standardized manufacturing system could be set up to manufacture standard sized pedestal structures 20 in nominal depths D of 24", 30" and 36" and nominal widths W of 15", 18", 30", 36" and 42" and in one or more standard heights. In other words, the height, width and depth dimensions are standardized so that individual modules, or furniture units, can be assembled together and maintain overall standard lengths, heights, widths, etc. For example, A-width modules may have a width which is equal to ⅔ the width of B-width modules and ½ the width of C-width modules to permit these modules to be combined in various combinations to form assemblage having a standard width.

An inventory of the basic panels and other common components, such as fasteners and braces, may then be maintained and an appropriately sized underlying pedestal structure 20 may then be assembled as needed to form a pedestal unit for any one of a number of different product lines. By utilizing the same standard underlying pedestal structures 20 for different product lines and minimizing the number of different panels and other components needed to manufacture differently sized standard pedestal structures 20, substantial reductions in inventory and substantial efficiencies in the manufacturing process are achievable.

Although underlying structure 20 may be identical for pedestal units in different product lines, the product lines can have substantially different styles by utilizing differently styled drawers, hardware and tops, or by attaching skirting, moldings, or additional side panels, to thereby finish underlying structure 20 in a manner which produces a distinguishable and aesthetically pleasing pedestal unit. Pedestal structure 20 may be used in a variety of different product lines which may have quite different styles and appearances. For example, contemporary styles often have relatively little ornamentation while more traditional styles often have relatively elaborate ornamentation.

By manufacturing the different furniture units with standard nominal depths and widths, similarly sized panel stock can be utilized in the manufacture of the different units. Additionally, the use of common exterior dimensions based upon common increments also promotes the modularity of the office system by allowing the different furniture units to be more easily combined in different combinations. The use of a common grid system for each of the different furniture units also promotes the efficient machining of the panels used in their manufacture.

Standardizing the construction of drawers used in a furniture system provides the opportunity for significant savings in manufacturing and inventory expenses. These savings can be achieved by using a limited number of standard sized "boxes", or drawer shells, using common hardware, and attaching different drawer fronts to the boxes to adapt the drawers for use in a particular product line. Using standard drawer shells which can have any number of different drawer fronts attached thereto also facilitates an assemble to order system of manufacture.

Figure 2A:
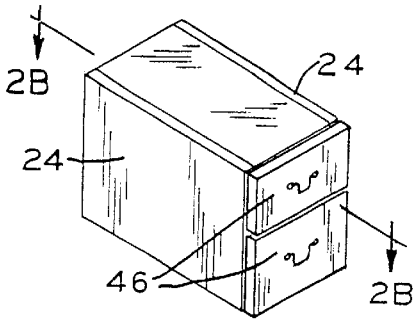
FIG. 2A is a perspective view of a pedestal unit having overlay drawers.
Figure 2B:
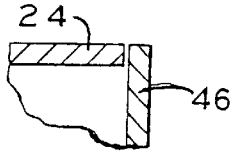
FIG. 2B is a fragmentary sectional top view of the pedestal unit of FIG. 2A, along line 2A–2B thereof.
Figure 3A:
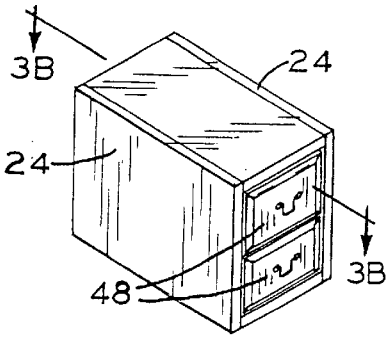
FIG. 3A is a perspective view of a pedestal unit having partially inset drawers.
Figure 4A:
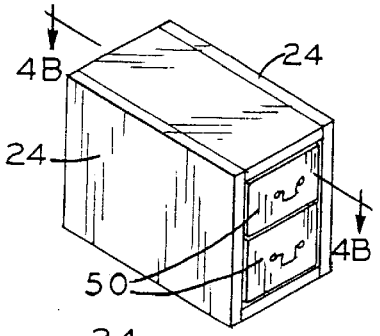
FIG. 4A is perspective view of a pedestal unit having fully inset drawers.
Figure 3B:
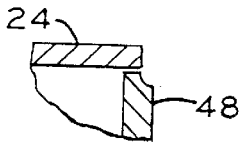
FIG. 3B is a fragmentary sectional top view of the pedestal unit of FIG. 3A, along line 3B—3B thereof.
Figure 4B:
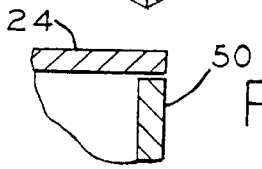
FIG. 4B is a fragmentary sectional top view of the pedestal unit of FIG. 4A, along line 4B—4B thereof.
Figure 5A:
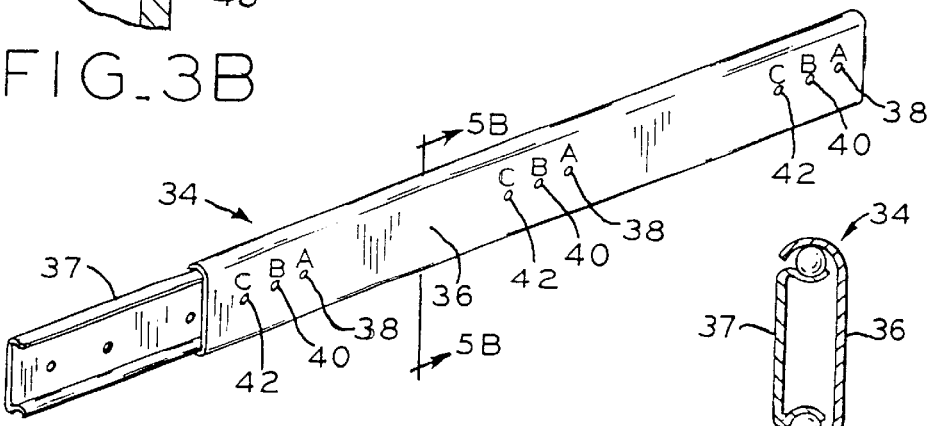
FIG. 5A is a perspective view of a three position drawer slide assembly.
Figure 5B:
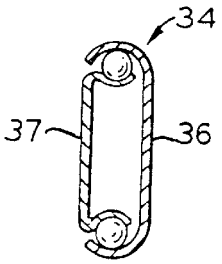
FIG. 5B is a sectional end view of the slide assembly of FIG. 5A, along line 5B—5B thereof.

To accommodate different furniture styles and designs, the standard drawer must be mountable in different positions relative to the front edge of the furniture unit. As shown in FIGS. 2–4, drawer fronts should be capable of being mounted in an overlay. position (FIGS. 2A, 2B); a ½ inset position (FIGS. 3A, 3B); and a fully inset position (FIGS. 4A, 4B). Three position drawer slide assembly 34, comprising first slide element 36 and second slide element 37 which telescopically slide relative to one another, provides a mechanism by which a standard sized drawer shell can be mounted in any of these three positions in a standard pedestal structure 20 or other standard furniture unit. As shown in FIGS. 5A and 5B, second slide element 37 may slide within first slide element 36 although, conversely, the first slide element may slide within the second slide element.

Three position drawer slide assembly 34 is attached to opposite side panels of a drawer shell and the adjacent furniture unit side panels such as side panel 24 of pedestal structure 20. The drawer slide channel which is attachable to panel 24, which in the shown embodiments is first slide element 36, has three sets of mounting holes. Each set of mounting holes consists of three holes, 38, 40, 42, having a common diameter and positioned linearly in the longitudinal direction. Referring to FIG. 5, the A (38), B (40) and C (42) hole of each set is positioned a common distance (an increment of 32 mm) from the corresponding A, B and C hole of the remaining sets. In other words, the distance 44 between the forwardmost hole A (38) and the intermediate hole A (38) is the same as the distance between the forwardmost hole B (40) and the intermediate hole B (40). This pattern holds for the C holes (42) and the rearmost set of holes.

The forwardmost hole A (38) is spaced approximately 37 mm from the leading edge of first slide element 36 to adapt slide element 36 for use on a panel 24 having a first vertical column of pre-bored holes which are spaced 37 mm from its front edge. Holes B (40) are positioned 11 mm in front of holes A (38) and holes C (42) are positioned 11 mm in front of holes B (40). This spacing of holes adapts slide assembly 34 for use with drawer fronts having a thickness of approximately ¾ inch (approximately 19 mm). Alternative spacings for use with alternative drawer front thicknesses are also possible, however, by maintaining a common drawer front thickness and common spacing between holes A, B and C, the number of different panels and slides which are required can be minimized.

Figure 6:
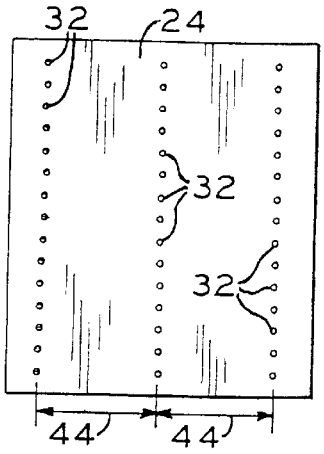
FIG. 6 is a view of the interior side of a standardized panel.

Referring to FIG. 6, side panel 24 has three vertical columns of pre-bored holes 32 offset by the same distance 44 by which mounting holes, 38, 40, 42 are offset. Thus, three position first drawer slide element 36 may be attached in three alternative positions with fasteners, such as screws, to side panel 24 through either holes A, B or C. By having pre-bored holes at different heights on panel 24, different configurations of drawer sizes can be accommodated within a furniture unit.

Figure 7:
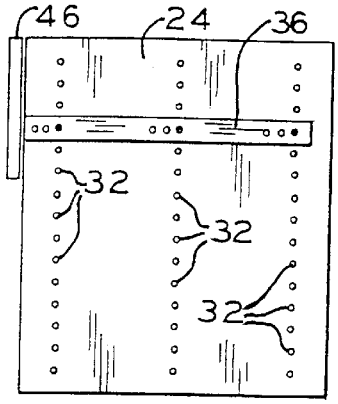
FIG. 7 is a view of a standardized panel with the drawer slide of FIG. 5 attached in an overlay position.
Figure 8:
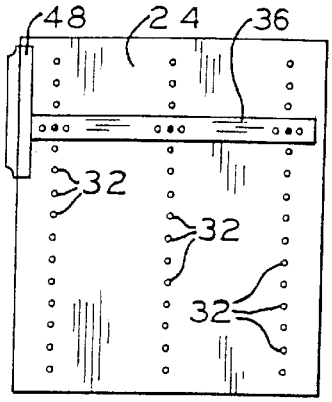
FIG. 8 is a view of a standardized panel with the drawer slide of FIG. 5 attached in a partially inset position.
Figure 9:
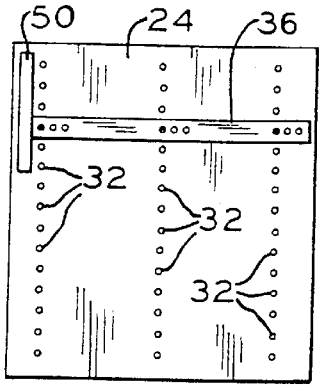
FIG. 9 is a view of a standardized panel with the drawer slide of FIG. 5 attached in a fully inset position.

In FIGS. 2A, 2B and 7, fasteners are inserted through holes A (38) of each set of mounting holes to attach first slide element 36 to panel 24, and drawer front 46 is installed in an overlay position. In this position, drawer front 46 may abut the front edge of panel 24 (FIG. 2B). In FIGS. 3A, 3B and 8, fasteners are inserted through holes B (40) of each set of mounting holes to attach first slide element 36 to panel 24, and drawer front 48 installed in a ½ inset position. In this position, approximately one half the thickness of drawer front 48 lies in front of, and the other half lies behind, the front edge of panel 24 (FIG. 3B). In FIGS. 4A, 4B and 9, fasteners are inserted through holes C (42) of each set of mounting holes to attach first slide element 36 to panel 24, and drawer front 50 is installed in a fully inset position. In this position, the front, exposed surface of drawer front 50 is approximately flush with the front edge of panel 24 (FIG. 4B).

A multiple of 32 mm is selected as distance 44 so that the pre-bored holes can be located on the 32 mm grid. Although a relatively large number of pre-bored holes are shown in each vertical column of FIG. 6, by limiting the pre-bored holes to only those holes necessary to account for each of the possible configurations of standard drawer sizes, the amount of machining for each panel 24 can be reduced and the possibility of attaching first slide element 36 thereto at an incorrect height can be minimized. For example, standard pedestal structure 20 could be sized to have either, from bottom to top, two file drawers or, alternatively, a file drawer, a box drawer and a pencil drawer. All side panels 24 would have a vertical arrangement of pre-bored holes which could accommodate either of these configurations as well as any other contemplated drawer size configuration. Thus, all side panels 24 can be identically machined and, with the use of three position drawer slide assembly 34, a variety of different configurations of standard sized drawers can be mounted in pedestal unit 20 in either an overlay, ½ inset or fully inset position.

Figure 10:
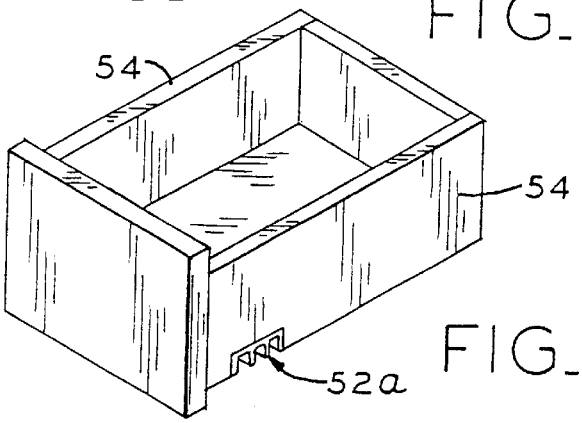
FIG. 10 is a perspective view of a drawer with a three bay lock block.
Figure 11:
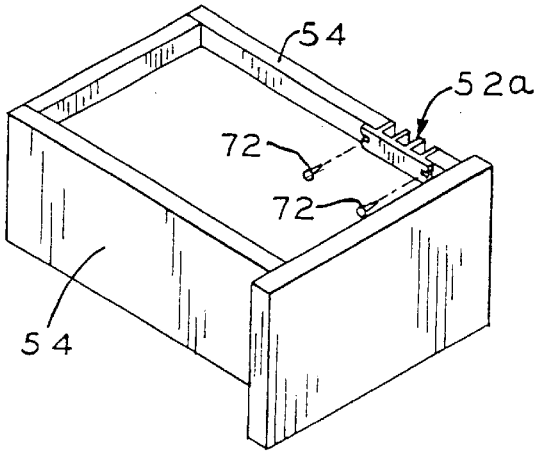
FIG. 11 is bottom, partially exploded, perspective view of a drawer with a three bay lock block.

An additional standardized component used on the standard drawer side panel is a three bay lock block 52 or 52*a*, which are mounted in a cutout recess provided in the lower edge at a standard location in at least one of opposed side panels 54 of each drawer, as shown in FIGS. 10 and 11. Lock blocks 52, 52*a* have three horizontally aligned locking bays 60, 62, 64. With respect to each drawer and for a standard locking bar 58 position, one of the locking bays will be properly positioned for receiving its respective locking pin 56 of the locking bar, i.e., vertically aligned therewith, in each of the three drawer closed positions, i.e., overlay, ½ inset, and fully inset. Locating lock block 52, 52*a* in a standard position in drawer side panel 54 promotes the efficient manufacture of side panels 54.

Figure 12:
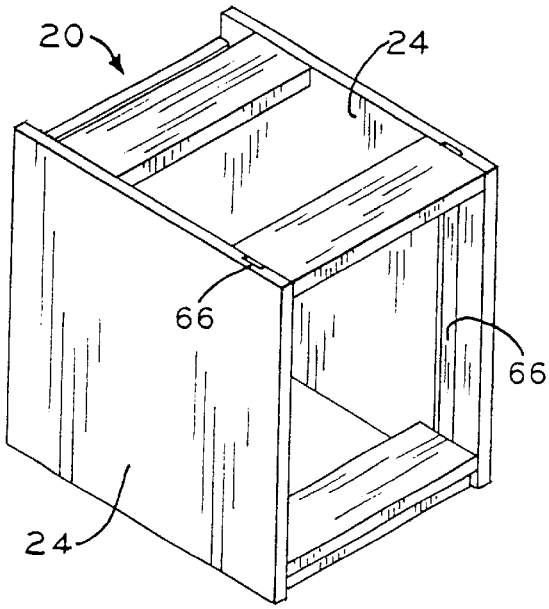
FIG. 12 is a perspective view of the structure of a pedestal unit.
Figure 13:
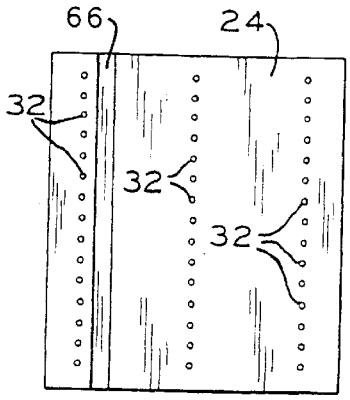
FIG. 13 is view of the interior side of a standardized panel including a locking bar channel.
Figure 14A:
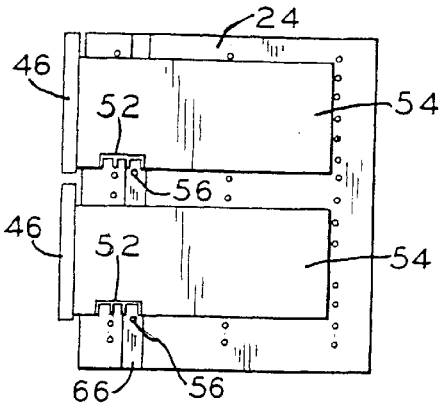
FIG. 14A is a schematic side view of a closed overlay drawer and side panel.
Figure 14B:
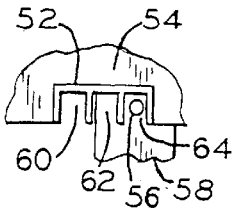
FIG. 14B is an enlarged schematic view of the locking pin engaging the lock block of the drawer shown in FIG. 14A.
Figure 15A:
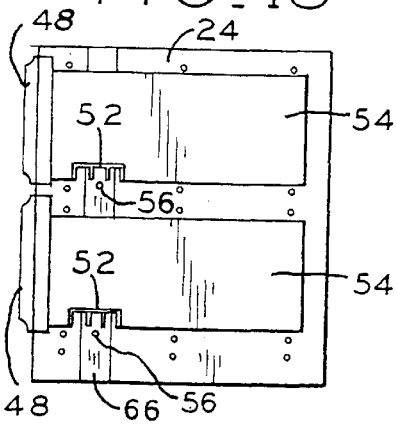
FIG. 15A is a schematic side view of a closed ½ inset drawer and side panel.
Figure 15B:
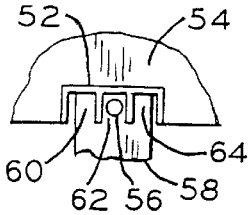
FIG. 15B is an enlarged schematic view of the locking pin engaging the lock block of the drawer shown in FIG. 15A.
Figure 16A:
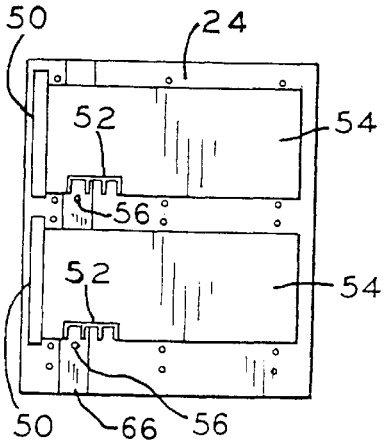
FIG. 16A is a schematic side view of a closed fully inset drawer and side panel.
Figure 16B:
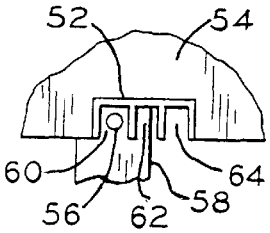
FIG. 16B is an enlarged schematic view of the locking pin engaging the lock block of the drawer shown in FIG. 16A.
Figure 17:
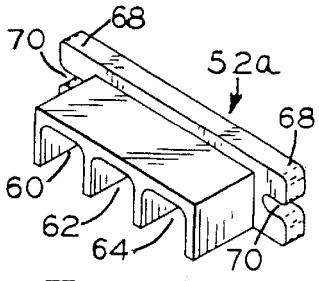
FIG. 17 is perspective view of three bay lock block.

As seen in FIGS. 12 and 13, vertical slot 66 is machined on the interior surface of each panel 24 and is sized to receive a locking bar 58 having locking pins 56 extending therefrom. Locking bar 58 slides within slot 66 between a first, unlocked position and a second, locked position, as described further below. Slot 66 of each panel 24 is in the same location to facilitate the efficient manufacture of panels 24. The distance between adjacent downward facing U-shaped lock bays 60, 62, 64 of lock block 52, 52*a* corresponds to the distance between mounting holes 38, 40, 42 of three position first slide element 36, i.e., approximately 11 mm. As schematically illustrated in FIG. 14, when a drawer is installed in an overlay position, in which mounting holes A (38) of first slide element 36 are attached to panel 24 at bores 32, rear lock bay 64 is positioned to receive locking pin 56 when the drawer is closed. Similarly, FIG. 15 schematically illustrates that when a drawer is installed in a 12 inset position using mounting holes B (40), intermediate lock bay 62 is positioned to receive locking pin 56 when the drawer is closed. When a drawer is installed in a fully inset position using mounting holes C (42), front lock bay 60 is positioned to receive locking pin 56 when the drawer is closed, as schematically illustrated in FIG. 16.

Figure 18:
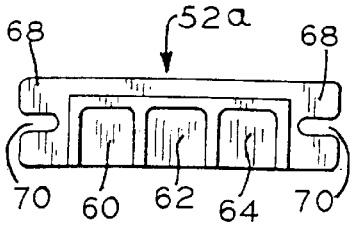
FIG. 18 is a side view of the lock block of FIG. 17.
Figure 19:
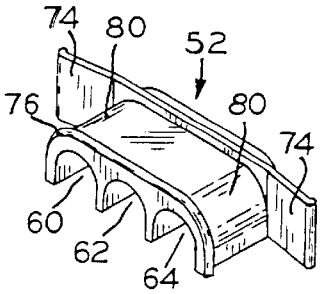
FIG. 19 is a perspective view of an alternative three bay lock block.
Figure 20:
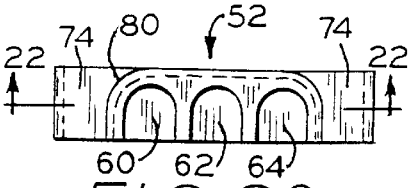
FIG. 20 is a side view of the lock block of FIG. 19.
Figure 21:
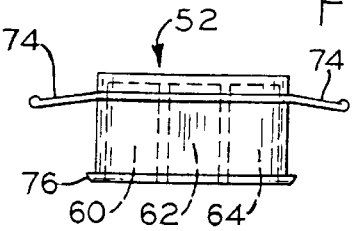
FIG. 21 is a top view of the lock block of FIG. 19.
Figure 22:
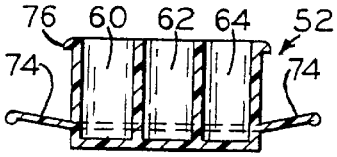
FIG. 22 is a sectional view of a lock block taken along line 22—22 of FIG. 20.
Figure 23:
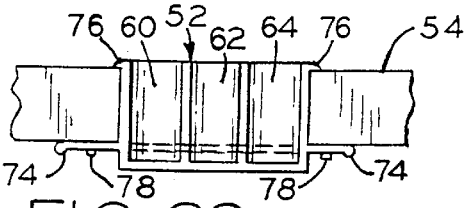
FIG. 23 is a sectional view of an installed lock block.

Although two lock block embodiments, 52, 52*a*, and corresponding drawer side panel cutout recess locations are illustrated, for the efficient manufacture of drawers, a single style of lock block would be chosen for use in all drawers. Ordinarily, only one lock block per drawer would be provided, although the lock block cutout recess may be provided in each drawer side panel 54 to rationalize machining operations. Lock block 52*a* is illustrated in FIGS. 11, 18 and 19, and includes two outwardly extending mounting wings 68 having slots 70 for fasteners 72 which secure locking block 52*a* in the cutout recess provided in the lower edge of drawer side panel 54.

Referring to FIGS. 19–23, lock block 52 includes relatively thin and resilient mounting wings 74 and front lip 76 which engage opposite side surfaces of drawer side panel 54 when lock block 52 is positioned in a cutout recess in the lower edge of drawer side panel 54. Resilient mounting wings 74 bias front lip 76 into engagement with drawer side panel 54 and thereby retain lock block 52 in a desired position until staples 78, or other appropriate fasteners, can be used to permanently secure locking block 52 in place.

Utilizing rounded shoulders 80 (FIGS. 19, 20) on lock block 52 enables the drawer side panel cutout recess which receives locking block 52 to be formed with rounded edges. A cutout having rounded corners is more easily formed in drawer side panels 54 than a cutout with rectilinear comers and can be routed at the same time that bore holes are placed in drawer side panel 54 for mounting a drawer slide. Lock block 52*a* may also be provided with rounded shoulders, providing similar benefits. A variety of different materials can be used to manufacture lock blocks 52, 52*a*, including 20% talc filled polypropylene and 10% glass filled polypropylene.

Figure 24:
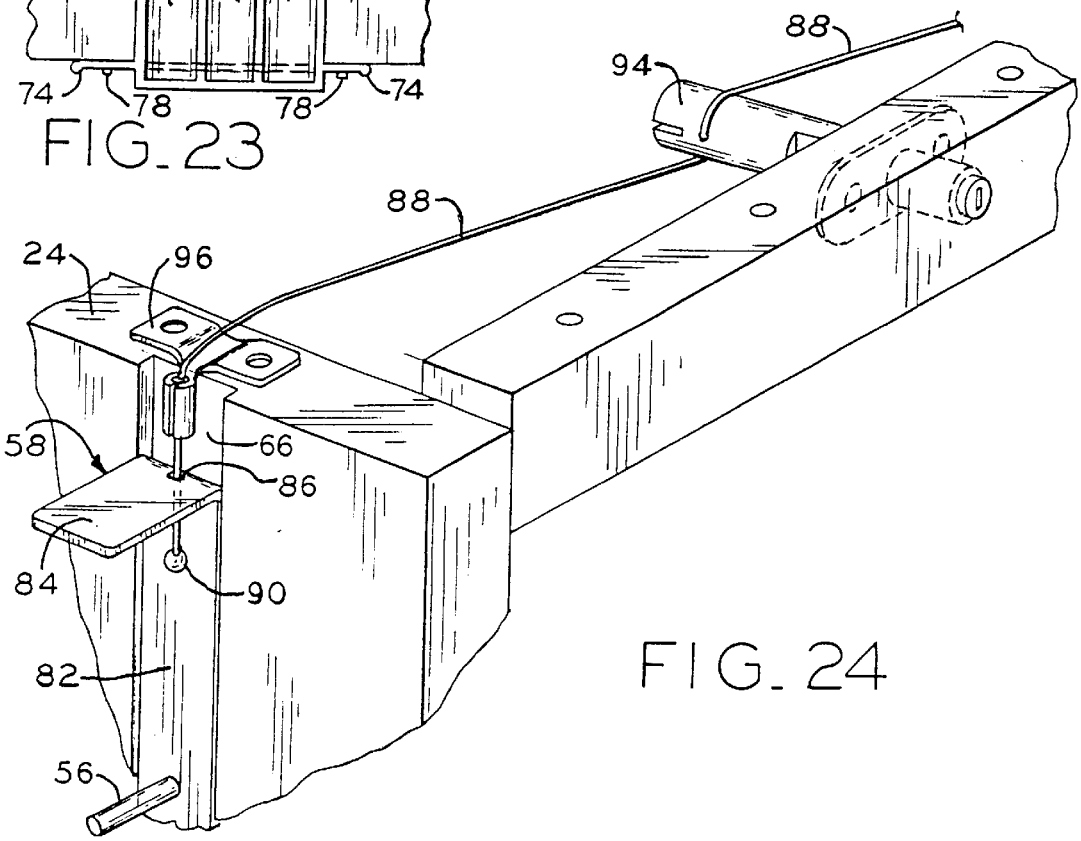
FIG. 24 is a perspective view of an installed locking system.
Figure 25:
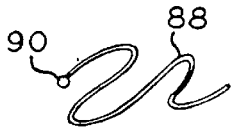
FIG. 25 is a perspective view of a cable and ball for a locking system.
Figure 27:
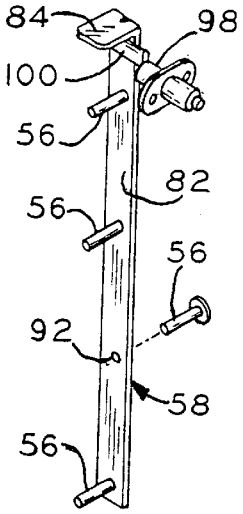
FIG. 27 is a perspective view of single bar locking system.
Figure 26:
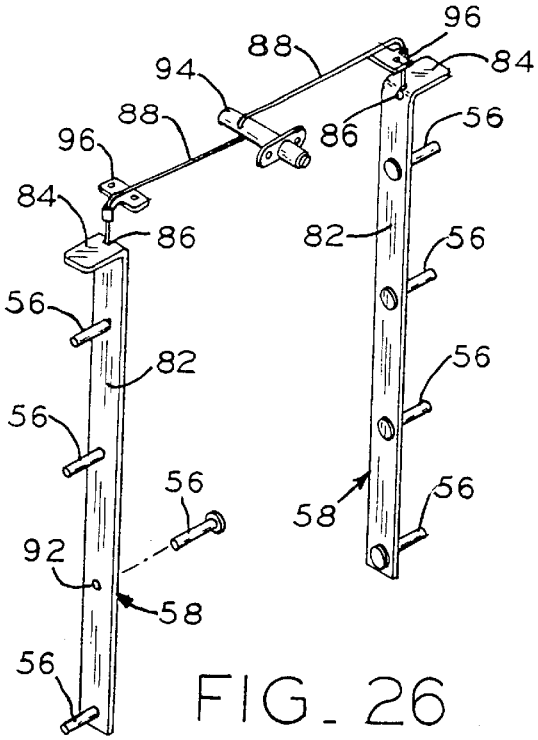
FIG. 26 is a perspective view of a two bar locking system.

Locking bar 58 is a common component which is used with all pedestal structures 20. Locking bar 58 includes vertical section 82 and horizontal section 84, with aperture 86 provided at the intersection of sections 82 and 84 through which cable 88 having ball 90 at one end (FIG. 25) may be routed, as best seen in FIG. 24. Each locking bar 58 also includes apertures 92 provided at predetermined locations on vertical section 82 which correspond to different drawer heights. Locking pins 56 are inserted through whichever apertures 92 are appropriate for the heights of the drawers to be used in the furniture unit. Pins 56 are then stamped to secure them to locking bar 58. Thus, pedestal structures 20 are common structures with identically machined side panels 24 having identical slots 66 in which a common locking bar 58 is slidingly disposed. Pedestal structures 20 can also accommodate a number of different drawer heights, with each drawer shell having an identical lock block 52. Each drawer also has drawer slide assemblies 34 attaching it to the furniture unit, whereby the drawer shells can be mounted in either an overlay, ½ inset or fully inset position. In any of these alternative closed drawer positions, the lock block may be engaged by locking pin 56 extending from locking bar 58.

As illustrated in FIGS. 24 and 26–28, locking bars 58 may be used alone or in combination. When it is desirable to use a single lock to secure two pedestal units 20, as for example when two pedestal units 20 are located on opposite ends of a desk, a central lock 94 can be placed between the pedestal units and cables 88 routed through apertures 86 to permit balls 90 to lift and lower locking bars 58 into and out of their locking positions, respectively engaging and disengaging pins 56 with a lock block in each of the drawers. Cable guides 96 are placed at the top edge of slots 66 to maintain cables 88 in their proper positions.

Figure 28:
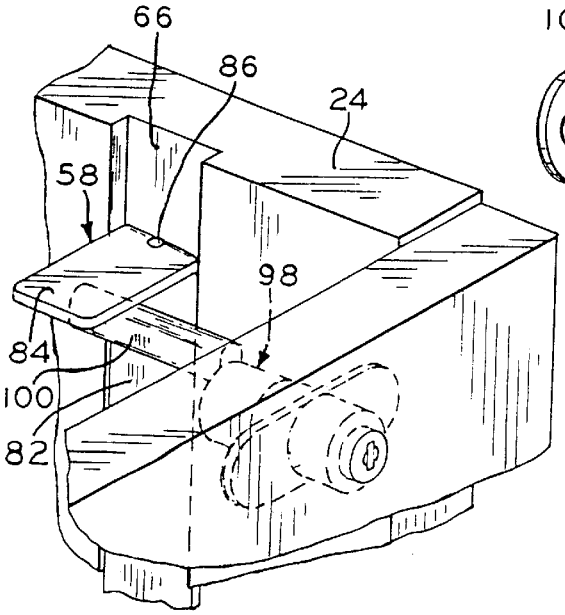
FIG. 28 is a view of another installed locking system.

Referring to FIG. 28, standalone pedestal units may have tenon lock 98 positioned near the upper end of slot 66. Lock 98 is provided with extension 100 which engages horizontal section 84 to lift and lower locking bar 58 into and out of its locking position, respectively engaging and disengaging pins 56 with a lock block in each of the drawers.

Figure 29:
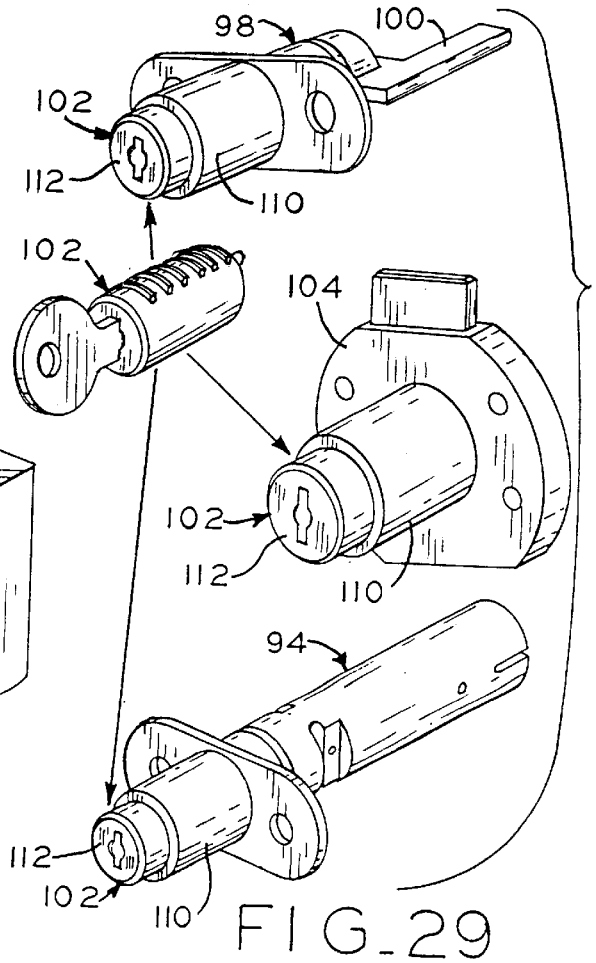
FIG. 29 is a perspective view of alternative locking mechanisms.

As illustrated in FIG. 29, a single type of lock core 102 can be used with central lock 94, tenon lock 98 and door lock 104, which may be used on a door storage unit (not shown). Both central lock 94 and tenon lock 98 have lock chassis 106 (FIG. 30) which has a square driver 108 and shell 110 for receiving lock core 102 and from which core 102 extends. Door lock 104 also includes shell 110 from which core 102 extends.

When furniture units are combined together in an office space, the lock assemblies of each unit are generally visible and, when aggregated in large numbers, the profusion of lock assemblies can have a undesirable effect on the aesthetics of the assemblage of furniture units. The present invention minimizes this negative effect by limiting the total surface area of the exposed lock assemblies.

Conventional lock assemblies have collars which are the same diameter as shell 110 and which extend to outer face 112 of lock core 102. The shell and collar are typically installed in a generally cylindrical bore hole and inhibit access to core wafers 114 to thereby inhibit the unauthorized opening of the lock. The present invention, however, provides a counterbored hole in the furniture panel for receiving the lock assembly. A collar is not used with the assembly, for the furniture panel itself functions as a collar for that portion of the core which is not disposed within shell 110 as can be seen in FIGS. 33 and 34. Thus, only face 112 of core 102 is exposed on the exterior surface of the furniture unit and neither the edge of shell 110 nor a collar is visible. This not only reduces the total surface area of the exposed lock assembly but also hides the annular shell edge which would otherwise visibly encircle, and thus visually emphasize, core face 112. In the exemplary embodiments, core 102 has an outer diameter of 13 mm and shell 110 has outside diameter of 17 mm. Thus, by using a counterbored hole with the lock assembly rather than a visible collar, the total exposed surface area of the lock assembly is reduced from approximately 227 $mm^2$ to approximately 133 $mm^2$, i.e., a reduction of roughly 40%.

In some situations it may be desirable to lock a door or double door with tenon lock 98 instead of door lock 104. Lock catch 116 may be used to engage tenon lock 98 in situations such as illustrated in FIG. 35. Tenon lock 98 may be installed in the door and lock catch 116 may be installed either on the lower surface of an adjacent horizontal panel or on the side of a vertically oriented panel (both positions are shown in FIG. 35).

With lock catch 116 attached to the lower surface of the adjacent horizontal panel (as shown in position A in FIG. 35), tenon lock 98 may also be used to lock the center drawer of a desk, the horizontal panel being the worksurface disposed above the center drawer, locking lip 118 of catch 116 engaged by tenon lock extension 100. As best seen in FIG. 36, lock catch 116 also includes a mounting plate 120 oriented at a 90° angle to locking lip 118. Mounting plate 120 is provided with a set of six bevelled apertures 122*a*–122*c* whereby two pre-bored holes may be placed in a standardized location on the panel surface to which catch 116 is attached by a pair of fasteners, such as wood screws, which extend into the two pre-bored holes through holes 122*a*, through holes 122*b*, or through holes 122*c*. Lock catch 116 can thereby be used with a door or center drawer positioned in either an overlay, a ½ inset, or a fully inset position respectively.

The center drawer of desk units generally have a relatively shallow height as they located above the kneespace of the desk and below the worksurface panel. The center drawer is generally not vertically stacked with another drawer because of the limited amount of space between the kneespace and worksurface and it is often desirable to suspend the center drawer from the lower surface of the worksurface panel with a bracket. Central locking rails, or skirting, however, may be positioned between the center drawer and the lower surface of the worksurface panel to provide space for the mounting of a central lock assembly. The skirting may not necessarily have the same height or be required for all center drawers. Thus, the center drawer for different desks may be suspended at different distances below the worksurface panel. Suspension bracket 124, illustrated in FIGS. 37 and 38, has suspension holes 126*a*–126*c* for suspending a center drawer at three different horizontal levels (corresponding to levels 126*a*, 126*b* and 126*c*). Suspension bracket 124 is attached to a the underside of a worksurface panel with fasteners inserted through apertures 128 located on the suspension bracket'shorter leg. The use of bracket 124 eliminates the need for spacers, shims or blocks which are often used to adjust the vertical position of brackets having only a single horizontal line of suspension holes.

Figure 39:
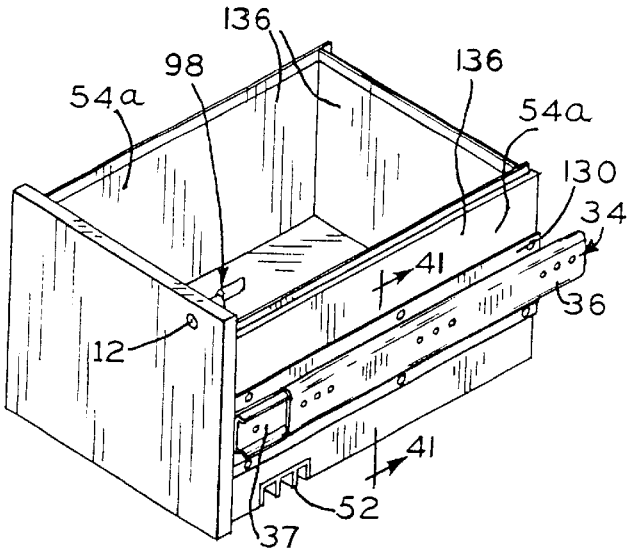
FIG. 39 is a perspective view of a standardized drawer.
Figure 41:
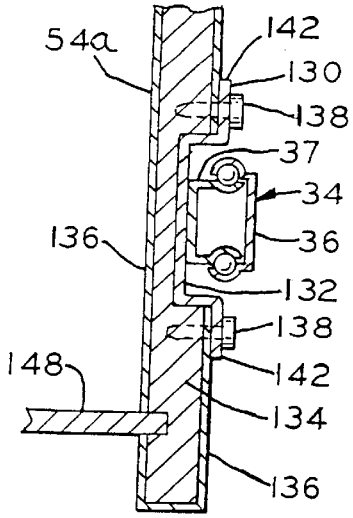
FIG. 41 is a sectional view of a drawer side with a hat section and three position drawer slide assembly.
Figure 40:
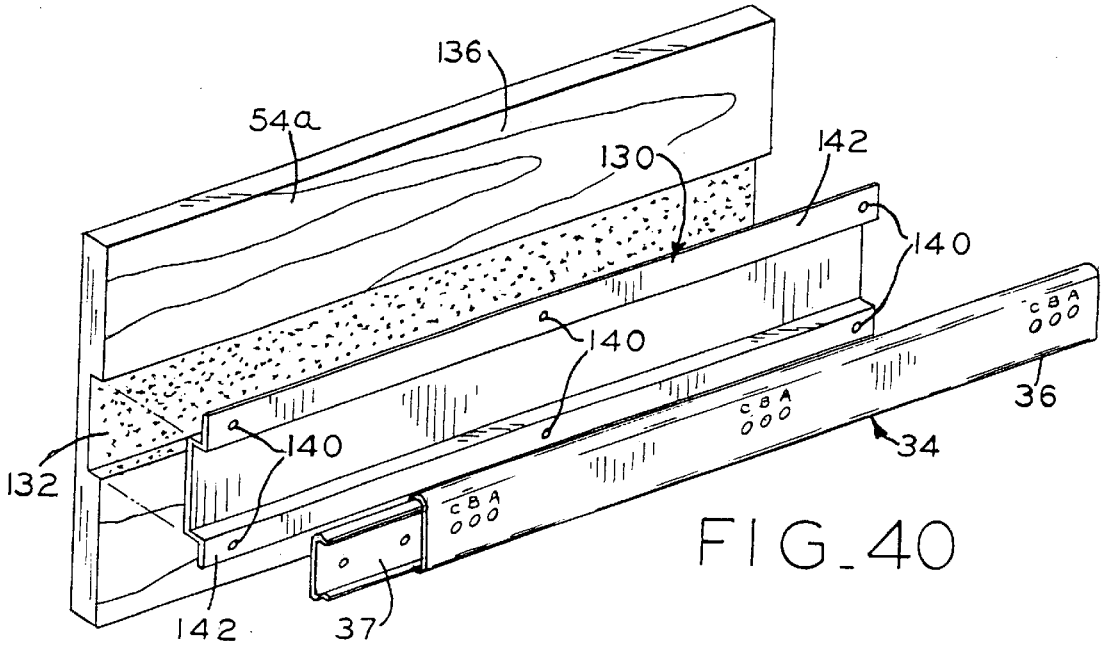
FIG. 40 is an exploded view of a drawer side, a hat section and a three position drawer slide assembly.

To reduce the width requirement for a drawer in a furniture unit, the present invention provides for another embodiment of a drawer which uses space-saving, elongate hat section 130, illustrated in FIGS. 39–41. The width of a file folder determines the width of a drawer and for letter and legal sized files, the typical inside drawer widths are 12⅛ inches and 15⅛ inches. It is desirable to place these drawers in pedestal units having exterior dimensions of 15 inches and 18 inches, respectively. This leaves 2⅞ inches for both side drawer panels 54, both pedestal side panels 24 and both drawer slide assemblies 34. It is aesthetically desirable to use ½ inch (approximately 13 mm) thick drawer side panels and ¾ inch (approximately 19 mm) thick pedestal side panels. The available space, however, is not sufficient for the use of ½ inch drawer side panels 54, ¾ inch pedestal side panels 24 and conventional side mounted, telescoping drawer slide assemblies 34 which each require ½ inch of horizontal space. Although it is possible to achieve the desired exterior width dimension by using undermount drawer slide assemblies (not shown), undermount slide assemblies undesirably consume vertical space. Further, reducing the thickness of drawer side panels 54 or pedestal side panels 24 to achieve the desired exterior dimensions would have a negative impact upon the aesthetics of the pedestal unit. Mounting hat section 130 within grooves 132 extending longitudinally in the outside surface of each drawer side panel 54*a* allows the distance between each drawer side panel and the adjacent pedestal side panel 24 to be reduced to 7/32" or 5.8 mm and thereby achieve the desired exterior furniture unit dimensions with the desired panel thicknesses. Of course, the use of hat section 130 as shown in FIGS. 39–41 will provide space savings regardless of the exact dimensions of the panels and slides which are used.

Prior to attaching hat section 130 to drawer panel 54*a*, innermost, second slide element 37 of three position slide assembly 34 is spot welded to hat section 130. Other methods of attaching a slide to hat section 130 may also be used. Referring to FIG. 41, drawer side panels 54*a* are comprised of particle board interior 318, the outermost surfaces of which are covered with birch veneer 136. Groove 132 may be machined into the side panel after application of the veneer, or the veneer may be applied after the groove is provided. The surfaces of groove 132, however, are not covered with the veneer. Hat section 130 extends the entire length of groove 132, and its attachment to drawer side panel 54*a* conceals the raw particle board surface the groove would otherwise reveal when the drawer is open. Hat section 130 is attached to drawer side panel 54*a*, outside of groove 132, with screws 138 (FIG. 41). Screws 138 extend through holes 140 (FIG. 40) in outer flanges 142 of hat section 130, which overlie the outermost side surfaces of panels 54*a*.

Figure 43A:
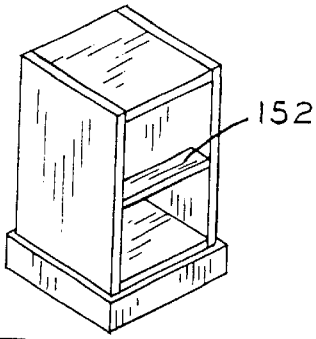
FIG 43A (PRIOR ART)
FIG. 43A is a perspective view of a prior art pedestal unit.
Figure 43B:
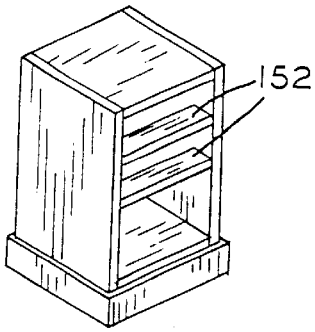
FIG 43B (PRIOR ART)
FIG. 43B is a perspective view of another prior art pedestal unit.
Figure 43C:
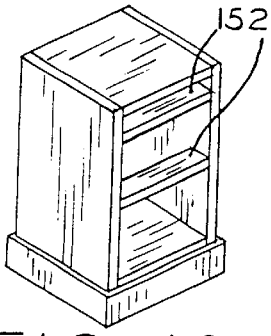
FIG 43C (PRIOR ART)
FIG. 43C is a perspective view of yet another prior art pedestal unit.
Figure 44:
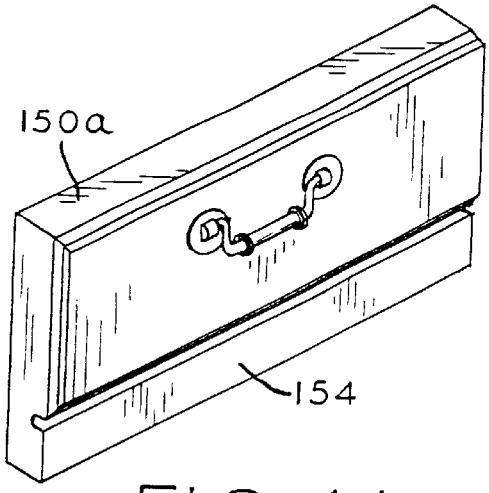
FIG. 44 is a perspective view of a drawer front having a faux rail.
Figure 45:
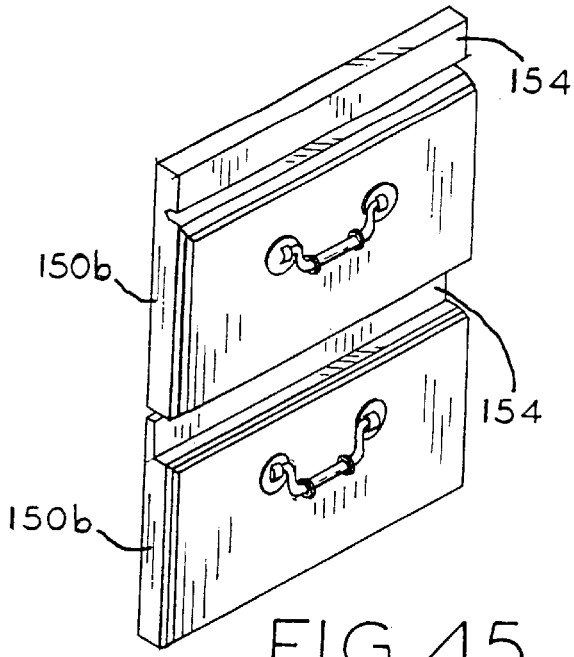
FIG. 45 is a perspective view of a combination of drawer fronts having faux rails.
Figure 46:
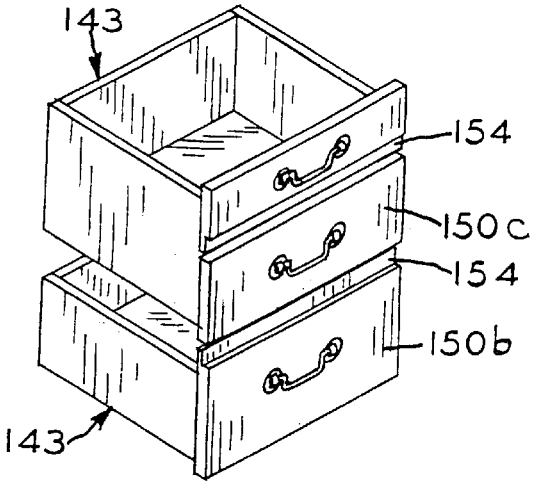
FIG. 46 is a perspective view of two drawers having drawer fronts with faux rails.

As can be seen in FIGS. 42A–42E, standard sized drawer shells 143*a*–143*e* of differing sizes which each include two side panels 54 or 54*a*, front panel 144, rear panel 146 and bottom 148, each appropriately sized to the corresponding drawer shell. The shell is secured together using glue and dowel construction although alternative manufacturing methods may also be employed. Attached to front panel 144 is drawer front 150, which may correspond to one of drawer fronts 46, 48 or 50 discussed herein above. Although each shell 143*a*–143*e* configuration is similar with respect to each product line, drawer fronts 150 attached thereto may differ by product line. FIGS. 43A–43C illustrate several pedestal units known in the prior art which utilize structural rails 152 to separate individual drawers on the pedestal unit's front face; each of these prior art pedestal units have different structures due to the differing placement of the rails. In contrast, pedestal structure 20 according to the present invention provides a common structure for all pedestals and does not include structural rails 152 located between the drawers. Many traditional furniture styles, however, utilize rails between the drawers. As can be seen in FIGS. 44–46, drawer fronts 150*a*–150*c*, each of which may particularly correspond to above-described drawer front 48 (½ inset in its drawer closed position), have faux rails 154 along an edge or separating the drawer front into sections. Faux rails 154 provide the appearance of a structural rail and permit drawer shells 143 and standardized pedestal structure 20 to be utilized in product lines having a traditional style. Faux rails 154 also permit larger file drawer fronts to appear as a combination of smaller drawers as shown in FIG. 46, where two file drawers have the appearance of a file, box and pencil drawer.

Figure 47:
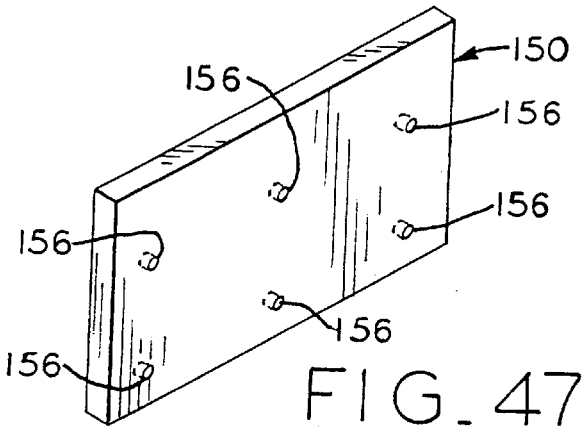
FIG. 47 is a perspective view of the interior side of a drawer front piece.
Figure 48:
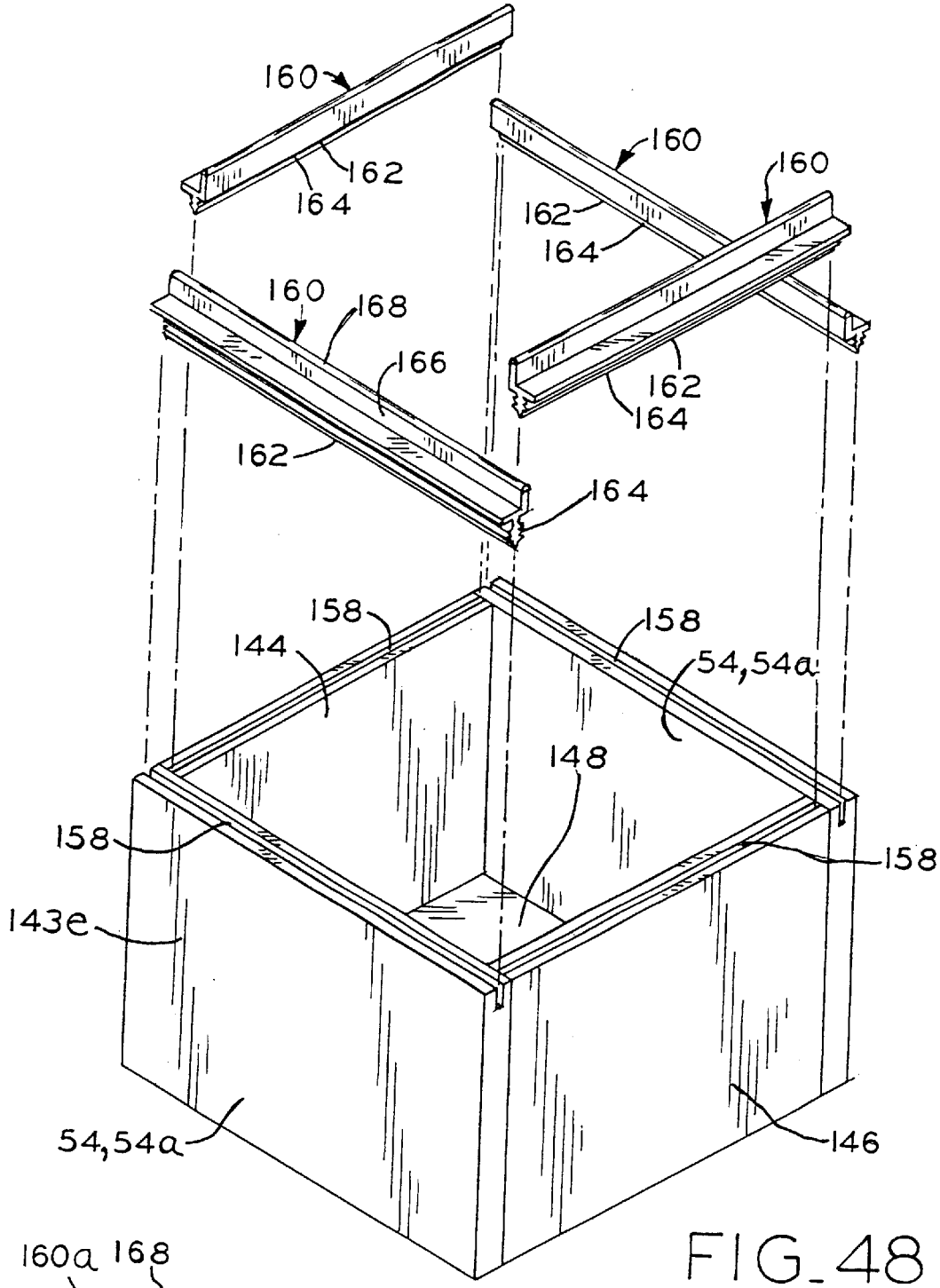
FIG. 48 is an exploded perspective view of a file drawer and filing rails.

Although the exterior surface of drawer fronts 150 differ, the interior surfaces thereof, shown in FIG. 47, include either four (4) or six (6) pre-bored blind holes 156 placed upon the above-described 32 mm grid to facilitate the attachment of a drawer front 150 to front drawer shell panel 144. The location of pre-bored blind holes 156 is maintained at standard locations relative to the top and bottom lip of drawer front 150 so that when drawer fronts 150 are attached to standardized drawers shells, which have standard locations for attachment of drawer fronts 150, the upper and lower lip of drawer fronts 150 can be maintained in a standard location to facilitate their use in standard pedestal structures 20 and the interchangeability and modularity of the finished drawers. 180 A file drawer shell 143*e* is shown in FIG. 48. Both side panels 54 or 54*a*, front panel 144 and rear panel 146 thereof each have slot 158 machined along their top edges. File support rails 160 are inserted into slots 158 on each of the panels of shell 143*e*. File support rail 160 may be extruded rigid polyvinyl chloride (PVC) or a similar material, and may have a Shore A hardness of approximately 95. Stem 162 of file support rail 160 includes ridges 164 which secure rails 160 to the drawer panels when stems 162 thereof are press-fitted into slots 158. The installation of rails 160 along the upper edge of panels 54 or 54*a*, 144 and 146 eliminates the need to veneer or finish the top edges of the file drawer panels.

Figure 49:
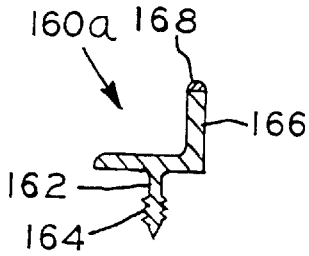
FIG. 49 is a cross sectional view of a filing rail.

Alternative file support rail 160*a* is shown in FIG. 49. File support rail 160*a* has a profile similar to rail 160 but upstanding file support extension 166 has upper tip 168 which is formed of a relatively soft material. Soft upper tip 168 inhibits sliding of file folder hooks (not shown) therealong and, thus, inhibits the movement of file folders and cross-file hardware when the drawer is slammed shut. To form alternative file support rail 160*a*, extension 166 and tip 168 may be coextruded, with extension 166 formed in a first die of a material such as PVC having a Shore A hardness of approximately 95, and tip 116 formed in a second die of a softer material such as PVC having a Shore A hardness of less than that of extension 166, such as in a range between approximately 85 and approximately 90, the tip and the extension fused together as they simultaneously leave their respective dies.

Figure 50:
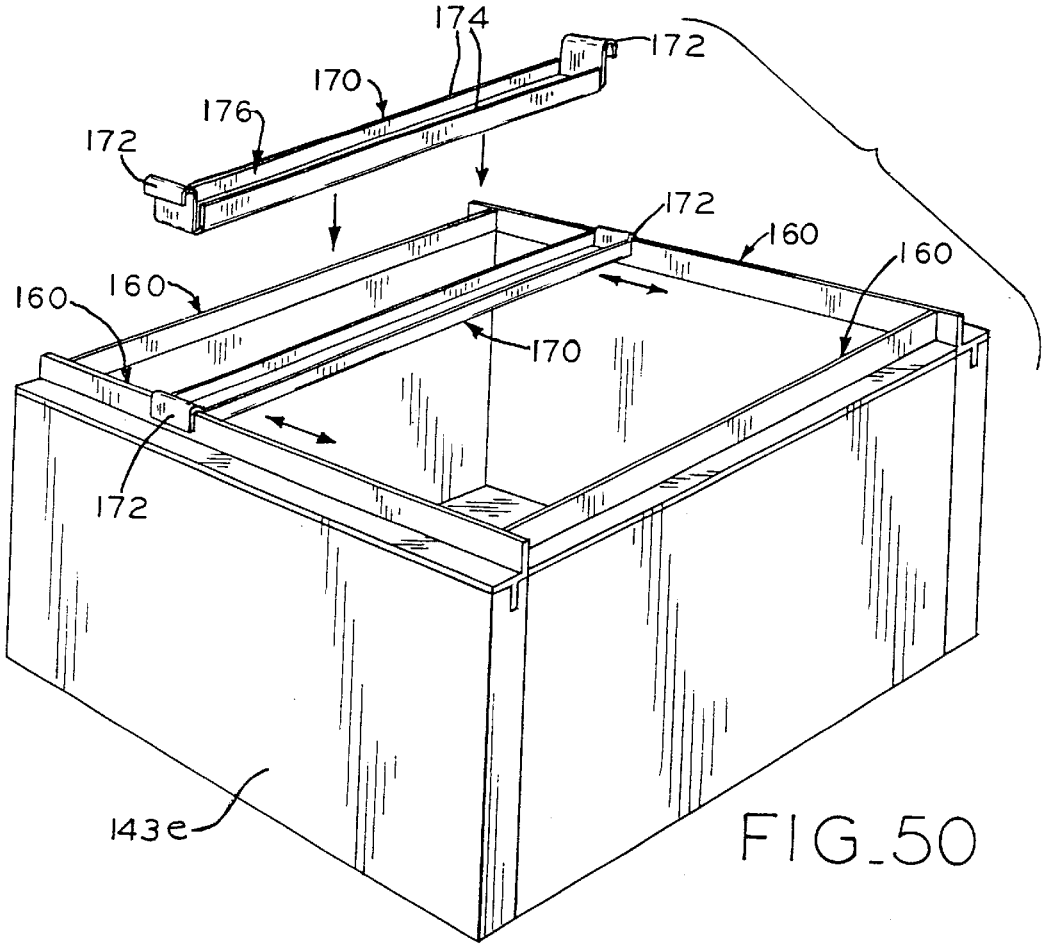
FIG. 50 is a perspective view of a file drawer and cross bar trays.
Figure 51:
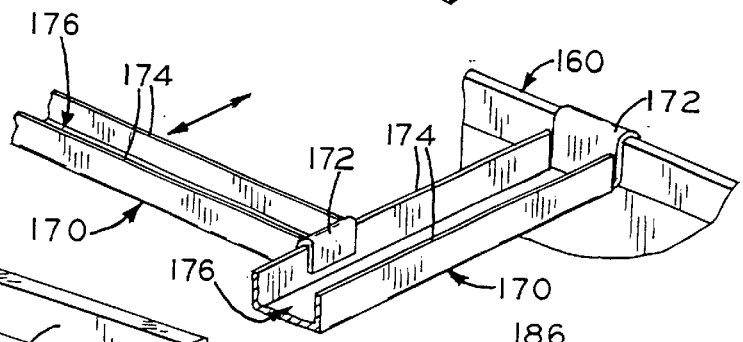
FIG. 51 is a partial perspective view of two cross bar trays.

Stamped steel cross bar 170 may also be used with support rails 160 as shown in FIGS. 50 and 51. Cross bars 170 can be adjusted as desired and are not limited to a set number of predetermined positions. Cross bar 170 includes generally J-shaped hooks 172 at both ends which open downwards and support cross bar 170 on a file support rail 160 or another cross bar 170. Cross bar 170 also includes two upstanding ribs 174 for supporting file folders and a recessed center portion 176 between ribs 174 which can be used for storage of small items such as pens or paperclips. Cross bars 170 may be dimensioned to be supported by either pair of parallel support rails 160. Cross bars 170 provide flexibility in the size of files which are supportable within drawer shell 143*e*. For example, crossbar 170 may positioned to support letter or A-4 sized files in a legal sized drawer.

Figure 42A:
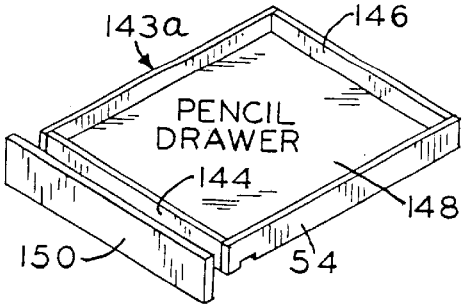
FIG. 42A is perspective, partially exploded view of a pencil drawer.
Figure 42B:
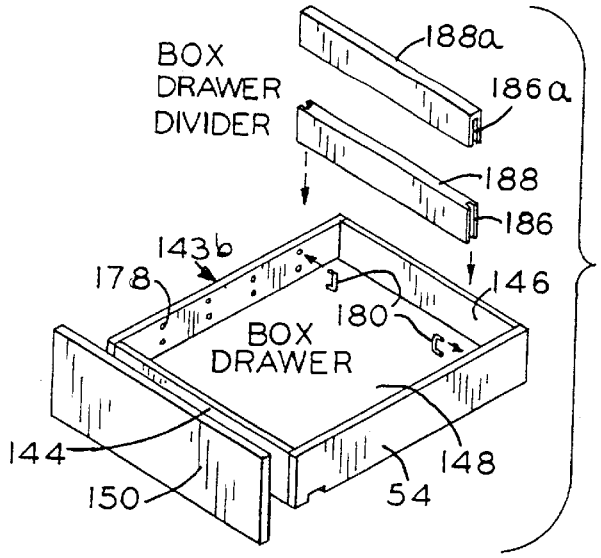
FIG. 42B is perspective, partially exploded view of a box drawer and divider.
Figure 42C:
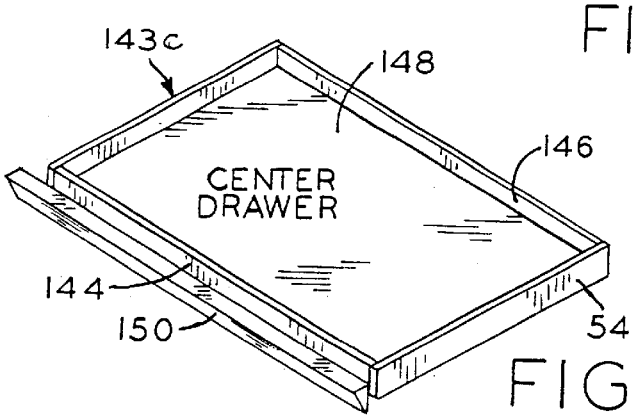
FIG. 42C is perspective, partially exploded view of a center drawer.
Figure 42D:
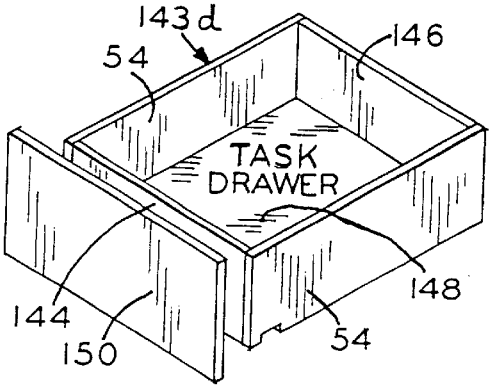
FIG. 42D is perspective, partially exploded view of a task drawer.
Figure 42E:
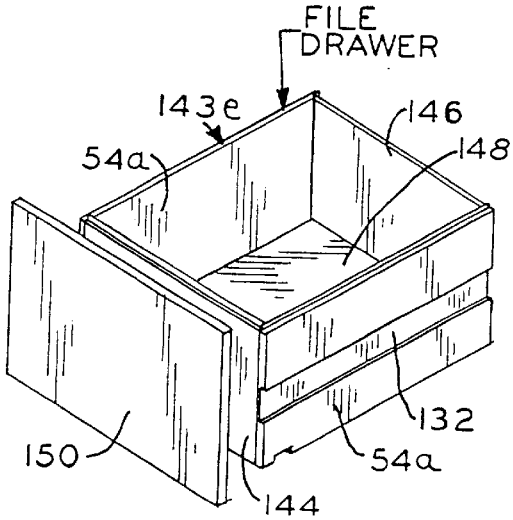
FIG. 42E is perspective, partially exploded view of a file or lateral file drawer.
Figure 52:
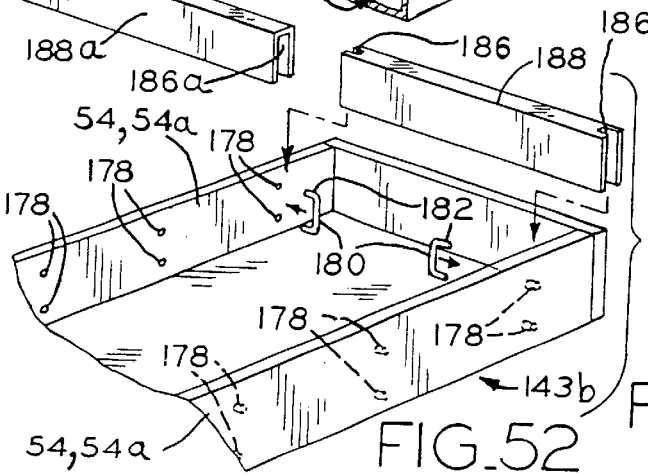
FIG. 52 is an exploded perspective view of a box drawer, divider clips and drawer divider.
Figure 53A:
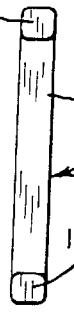
FIG. 53A is a side view of a divider clip.
Figure 53B:
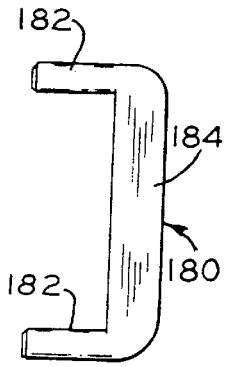
FIG. 53B is a front view of a divider clip.

As can be seen in FIGS. 42B and 52, standard box drawer shells 143*b* are adapted to receive divider panel 188 or 188*a* therein. The interior sides of the box drawer side panels 54, 54*a* are provided with pre-bored blind holes 178 located on the 32 mm grid. Generally U-shaped divider clip 180 is provided with two legs 182 which are insertable into holes 178 as illustrated in FIG. 52. Clip 180 also includes vertically-extending middle section 184 which is engaged within slot 186 located on each end of divider panel 188 or within U-shaped channel 186*a* of divider panel 188*a*. With reference to FIG. 52, panel 188 or panel 188*a* is installed by lowering it over clips 180 such that clips 180 are slidably received in slots 186 or channel 186*a*, respectively. Panel 188, 188*a* is not permanently attached to clips 180 and can be repositioned by removing it, repositioning clips 180 in different holes 178 and slidably lowering panel 188, 188*a* over the repositioned clips.

Figure 54:
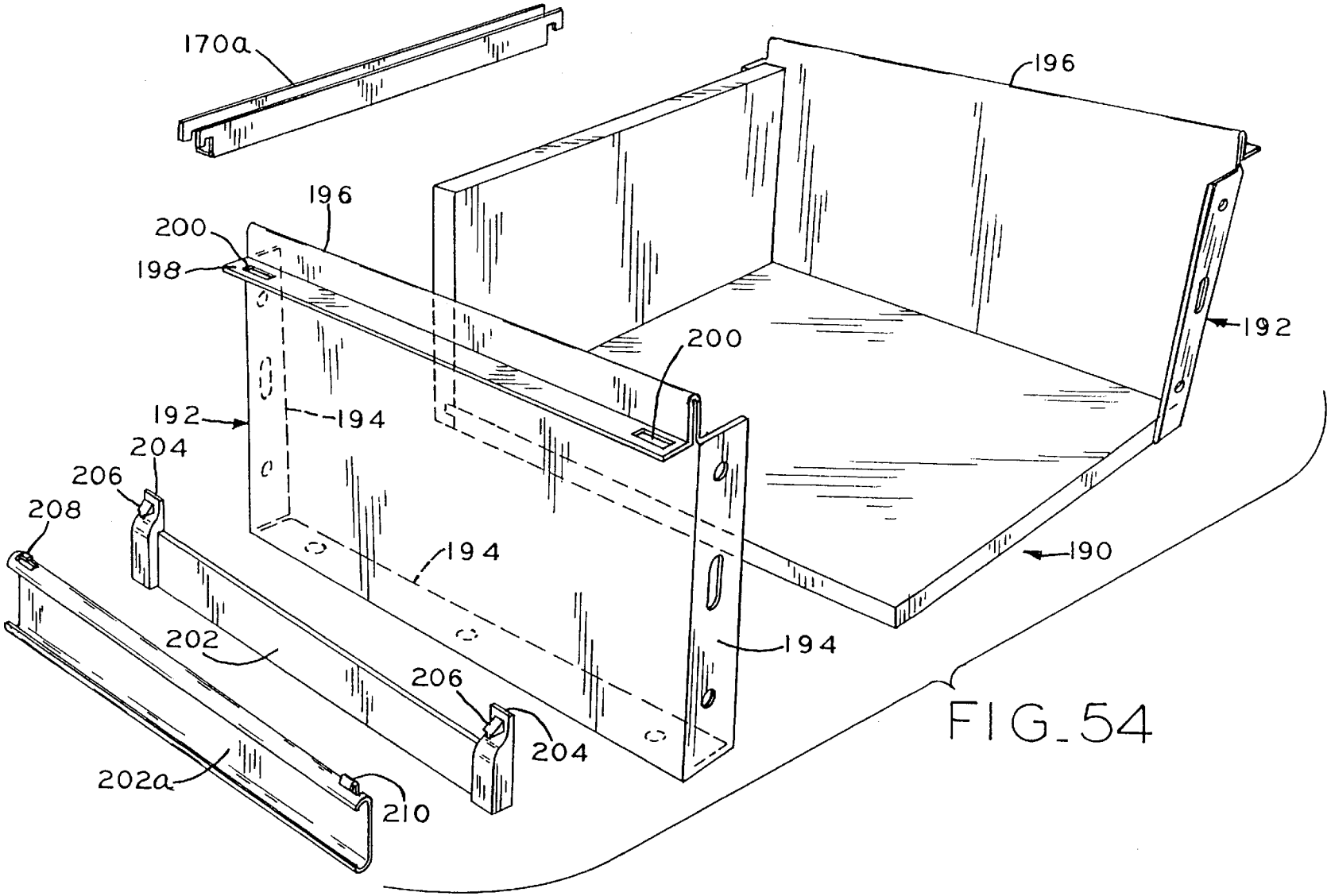
FIG. 54 is an exploded perspective view of an alternative drawer structure having metal side panels.

An alternative drawer construction is shown in FIG. 54. Drawer 190 is manufactured using stamped metal sides 192. Metal sides 192 include flanges 194 for attachment to wooden drawer front, bottom and rear panels. The upper edge of metal side 192 is bent to form a file support 196 and a lateral flange 198. Lateral flange 198 includes slots 200 which are used to secure slides 202 to metal sides 192. Slides 202 include projections 204 which are insertable through slots 200. Depressible catches 206 are depressed and pass through slots 200 with projections 204. After insertion through slots 200, catches 206 are once again biased outwards and prevent the removal of projections 204 from slots 200. Drawer 190 may alternatively employ slides 202*a*. Slide 202*a* attaches to lateral flange 198 by means of integral hook 208, which engages one flange slot 200, and tab 210, which extends through the other flange slot 200 and is retained therein by means of a depressible catch provided on the tab. Slides 202 and 202*a* may each be made of plastic. Also shown in FIG. 54 is alternative file cross bar 170*a*.

While this invention has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A furniture unit in which a drawer moves in a longitudinal direction;

wherein said drawer comprises a shell having a side panel in which a groove is provided, said groove extending in said longitudinal direction, an insert having a hat-shaped cross section mounted in said groove, said insert having flanges adjacent said side panel and outside said groove, said insert attached to said shell outside of said groove via said flanges, and a slide element is disposed in said hat-shaped section, whereby the space between said drawer side panel and an adjacent member is minimized.

2. The furniture unit of claim 1, wherein said hat section is a steel stamping.

3. The furniture unit of claim 2, wherein said slide element is welded to said hat section.

4. The furniture unit of claim 1, wherein said slide element is a first slide element, and further comprising a second slide element operatively connected to said first slide element, said second slide element attached to said adjacent member.

5. The furniture unit of claim 4, wherein said second slide element is attached to said adjacent member at a standardized slide mounting location on said adjacent member.

* * * * *